US010803835B2

(12) United States Patent
Chen

(10) Patent No.: US 10,803,835 B2
(45) Date of Patent: Oct. 13, 2020

(54) METHOD FOR DRIVING MULTIPLEXER AND DISPLAY DEVICE

(71) Applicant: AU Optronics Corporation, Hsin-Chu (TW)

(72) Inventor: Ping-Lin Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/601,951

(22) Filed: Oct. 15, 2019

(65) Prior Publication Data

US 2020/0265804 A1 Aug. 20, 2020

(30) Foreign Application Priority Data

Feb. 14, 2019 (TW) ..... 108104990 A

(51) Int. Cl.
*G09G 5/18* (2006.01)

(52) U.S. Cl.
CPC ..... *G09G 5/18* (2013.01); *G09G 2310/0297* (2013.01)

(58) Field of Classification Search
CPC ..... G09G 5/18; G09G 2310/0297
See application file for complete search history.

(56) References Cited

U.S. PATENT DOCUMENTS 9,672,767 B2 6/2017 Kim
2009/0002280 A1* 1/2009 Kim ..... G09G 3/3258 345/76
2016/0078845 A1 3/2016 Lin et al.

* cited by examiner

*Primary Examiner* — Charles V Hicks
(74) *Attorney, Agent, or Firm* — WPAT, PC

(57) ABSTRACT

A method for driving the multiplexer is disclosed herein. The method includes the following operations: in a first frame, a first control signal is configured to enable a partial of switch of a first multiplexer and a partial of switch of a second multiplexer; and in a second frame, a second control signal is configured to enable another partial of switch of the first multiplexer and another partial of switch of the second multiplexer.

15 Claims, 8 Drawing Sheets

METHOD FOR DRIVING MULTIPLEXER AND DISPLAY DEVICE

CROSS-REFERENCE TO RELATED APPLICATION

This application claims priority to Taiwanese Application Serial Number 108104990, filed on Feb. 14, 2019, which is herein incorporated by reference.

BACKGROUND

Field of Invention

The present invention relates to a method for driving the multiplexer and display device. More particularly, the present invention relates to a method and display device capable of adjusting multiplexer enabling frequency for driving the multiplexer.

Description of Related Art

The low temperature poly-silicon thin-film transistors (LTPS TFT) having the high charge carrier mobility and small size are suitable for the display panel with high resolution, narrow bezel and low power consumption. The multiplexers are widely used in the display device field to reduce the amount of the source driver IC, which can reduce the area occupied by the source driver chip. However, when the update rate is increased, the enabling time period of the multiplexer is decreasing, so that the charging time of the sub-pixels is insufficient. Since the charging time of the partial or full area of the display panel is insufficient, it will caused that the contrast ratio of the display panel is decreased.

SUMMARY

The invention provides a method for driving the multiplexer. The method includes operations of: in a first frame, enabling a portion switch of a first multiplexer and a portion switch of a second multiplexer by a first control signal, and disabling another portion switch of the first multiplexer and another portion switch of the second multiplexer by a second control signal; and in a second frame, disabling the portion switch of the first multiplexer and the portion switch of the second multiplexer by the first control signal, and enabling the another portion switch of the first multiplexer and the another portion switch of the second multiplexer by the second control signal.

The invention provides a display device. The display device includes a plurality of gate lines, a plurality of data lines, a plurality of multiplexers and a processor. The multiplexers are electrically connected to the plurality of data lines, wherein the plurality of multiplexers comprise a first multiplexer and a second multiplexer. The processor is electrically connected to the plurality of multiplexers, in a first frame, the processor is configured to enable a portion switch of the first multiplexer and a portion switch of the second multiplexer by a first control signal, and disable another portion switch of the first multiplexer and another portion switch of the second multiplexer by a second control signal; and in a second frame, the processor is configured to disable the portion switch of the first multiplexer and the portion switch of the second multiplexer by the first control signal, and enable the another portion switch of the first multiplexer and the another portion switch of the second multiplexer by the second control signal.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
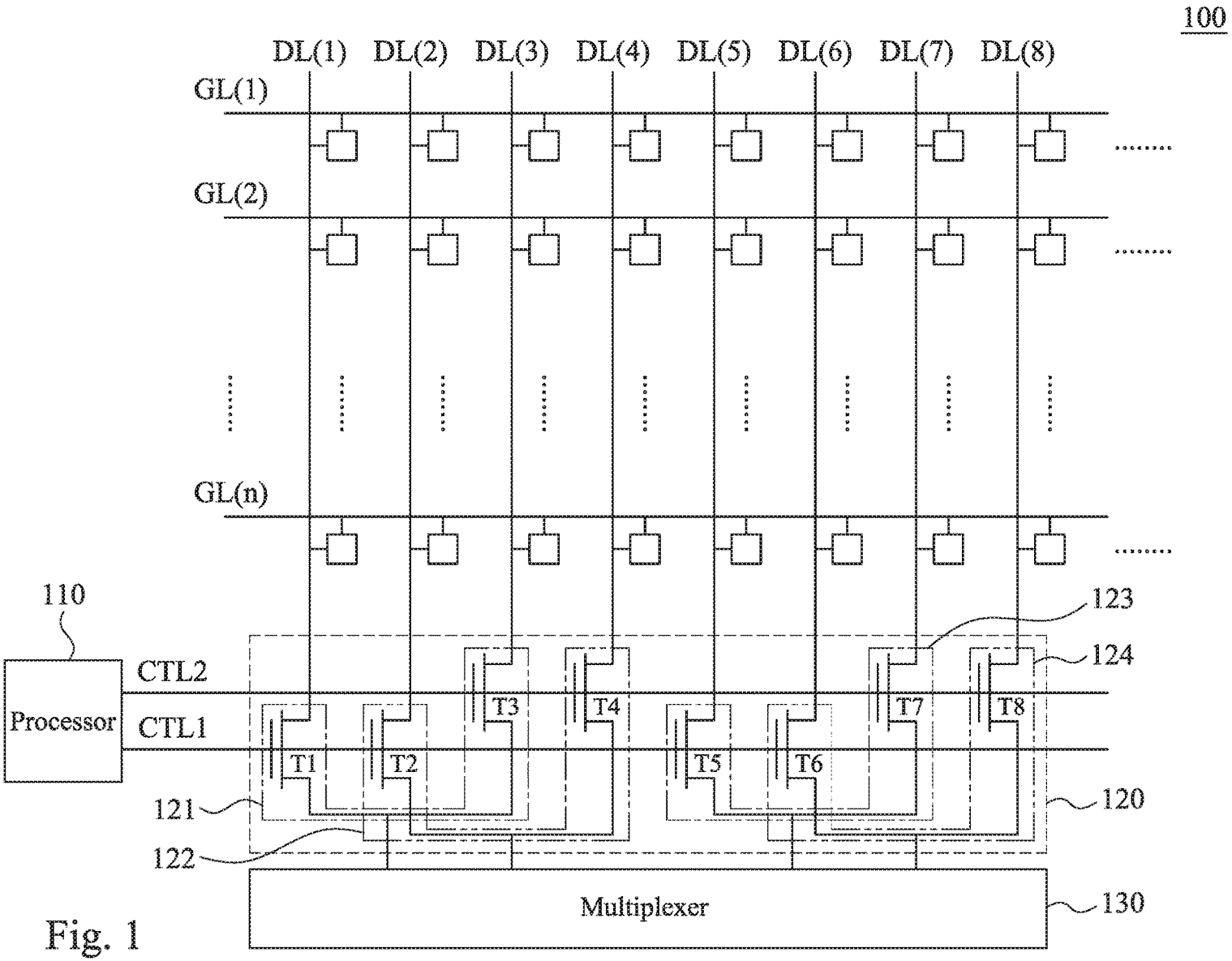
FIG. 1 is a circuit diagram of a display device according to one embodiment of the present disclosure.

Reference will now be made in detail to the present embodiments of the invention, examples of which are illustrated in the accompanying drawings. Wherever possible, the same reference labels are used in the drawings and the description to refer to the same or like parts, components, or operations.

Reference is made to FIG. 1. FIG. 1 is a circuit diagram of a display device 100 according to one embodiment of the present disclosure. As shown in FIG. 1, the display device 100 includes a processor 110, multiplexers 120, a source driver 130, data lines DL(1)~DL(8) and gate lines GL(1)~GL(n). The multiplexers 120 are electrically coupled to the data lines DL and the source driver 130. With respect to the four multiplexers 121, 122, 123 and 124 and the associated switches T1~T8 as the embodiment shown in FIG. 1, the multiplexer 120 includes switches T1, T2, T3 and T4. The multiplexers 121 and 123 are electrically coupled to the odd-numbered data lines DL(1), DL(3), DL(5) and DL(7), and the multiplexers 122 and 124 are electrically coupled to the even-numbered data lines DL(2), DL(4), DL(6) and DL(8). The processor 110 is configured for providing the control signal CTL1 and CTL2 to control the operation of the multiplexers 121~124.

The multiplexer 121 includes switches T1 and T3. The first end of the switch T1 is electrically connected to the data line DL(1); the second end of the switch T1 is electrically connected to the source driver 130, and the control end of the switch T1 is configured to receive the control signal CTL1. The first end of the switch T3 is electrically connected to the data line DL(3); the second end of the switch T3 is electrically connected to the source driver 130, and the control end of the switch T3 is configured to receive the control signal CTL2. The multiplexer 122 includes switches T2 and T4. The first end of the switch T2 is electrically connected to the data line DL(2); the second end of the switch T2 is electrically connected to the source driver 130, and the control end of the switch T2 is configured to receive the control signal CTL1. The first end of the switch T4 is electrically connected to the data line DL(4); the second end of the switch T4 is electrically connected to the source driver 130, and the control end of the switch T4 is configured to receive the control signal CTL2. The multiplexer 123 includes switches T5 and T7; the multiplexer 124 includes switches T6 and T8. The connection and operation of the switches T5-T8 of the multiplexers 123 and 124 are similar with connection and operation of the switches T1~T4 of the multiplexers 121 and 122. For the sake of brevity, those descriptions will not be repeated here.

Figure 2:
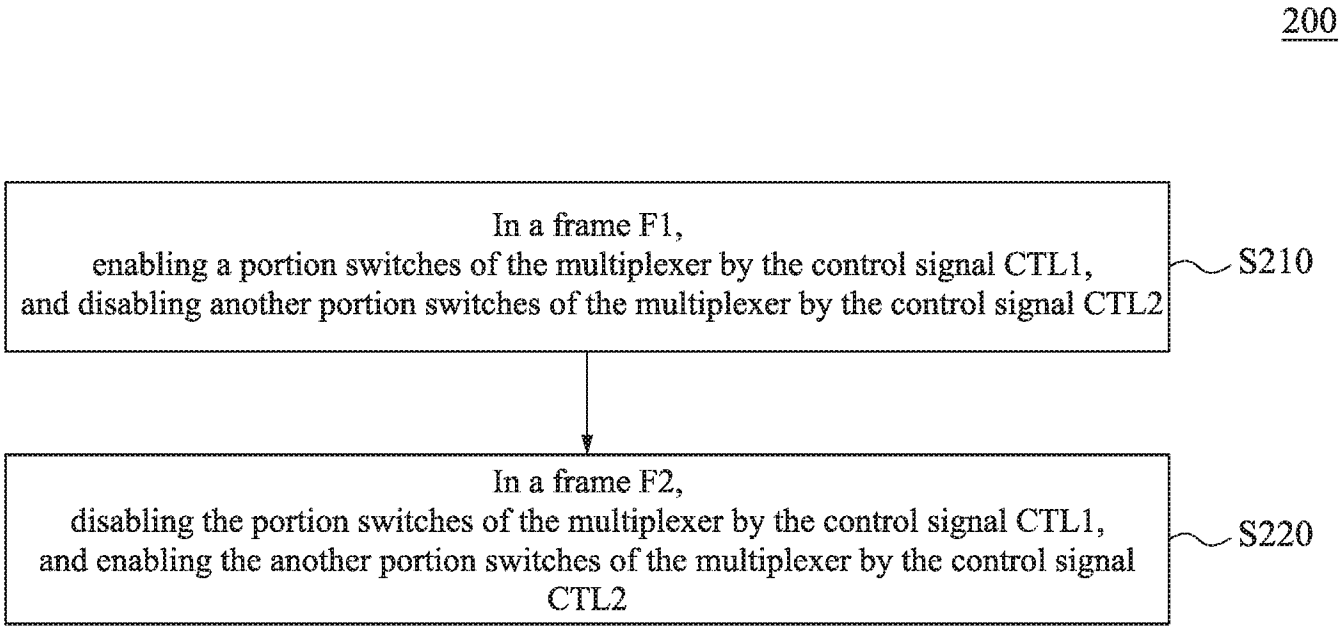
FIG. 2 is a flow diagram illustrating a method for driving the multiplexer according to an embodiment of this disclosure.

Reference is made to FIG. 1 and FIG. 2. FIG. 2 is a flow diagram illustrating a method 200 for driving the multiplexer according to an embodiment of this disclosure. In the embodiment, the method 200 can be applied to the display device 100 of FIG. 1. The processor 110 is configured to conduct different multiplexers 120 to enable different data lines according to the steps described in the following method 200.

As shown in FIG. 2, the method 200 firstly executes step S210, in a frame F1, enabling a portion switches of the multiplexer by the control signal CTL1, and disabling another portion switches of the multiplexer by the control signal CTL2. In this embodiment, the amount of the multiplexer 120 is determined by the amount of the data line and the type of the multiplexer. For example, it is assumed that the amount of the data line is 1024 and the type of the multiplexer is the 1-to-2 multiplexer. In this case, the amount of the multiplexer is 512. Afterwards, the odd-numbered multiplexer is electrically connected to the corresponding odd-numbered data line; the even-numbered multiplexer is electrically connected to the corresponding even-numbered data line.

Figure 3A:
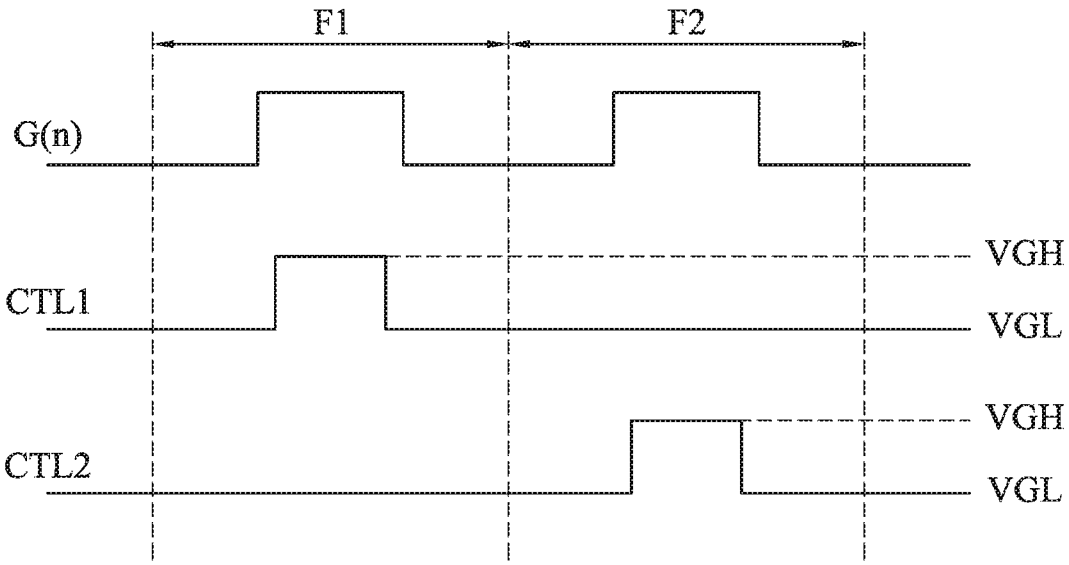
FIG. 3A is a timing diagram illustrating the multiplexer according to a first embodiment of this disclosure.

Reference is made to FIG. 1 to FIG. 3A. FIG. 3A is a timing diagram illustrating the multiplexer according to a first embodiment of this disclosure. As shown in FIG. 3A, in the frame F1, the control signal CTL1 switches to a high voltage level VGH, and is configured to enable the switches T1, T2, T5 and T6. At the same time, the control signal CTL2 is at a low voltage level VGL, and is configured to disable the switches T3, T4, T7 and T8. When the gate driving signal G(n) switches to the enable voltage level, the gate driving signal G(n) is configured to enable gate line GL(n), and the control signal CTL1 is configured to enable the switches T1, T2, T5 and T6. When the switches T1, T2, T5 and T6 are conducted, the data voltage is written to the pixel circuit coupled to the gate line GL(n) and the data lines DL(1), DL(2), DL(5) and DL(6).

In this embodiment, the odd-numbered data line has the opposite voltage polarity to the even-numbered data line, and the multiplexers only conduct the portion switches in this operation. Thus, it is assumed that the update rate of the display device is 240 Hz determined by the gate driver (do not shown in figure), but actually the update rate of the display device will be down to 120 Hz.

Afterwards, the method 200 executes step S220, in a frame F2, disabling the portion switches of the multiplexer by the control signal CTL1, and enabling the another portion switches of the multiplexer by the control signal CTL2. As shown in FIG. 3A, in the frame F2, the control signal CTL1 is at the low voltage level VGL, and is configured to disable the switches T1, T2, T5 and T6. At the same time, the control signal CTL2 switches to the high voltage level VGH, and is configured to enable the switches T3, T4, T7 and T8. Based on aforesaid embodiments, when the gate driving signal G(n) switches to the enable voltage level, the gate driving signal G(n) is configured to enable gate line GL(n), and the control signal CTL2 is configured to enable the switches T3, T4, T7 and T8. When the switches T3, T4, T7 and T8 are conducted, the data voltage is written to the pixel circuit coupled to the gate line GL(n) and the data lines DL(3), DL(4), DL(7) and DL(8).

Figure 3B:
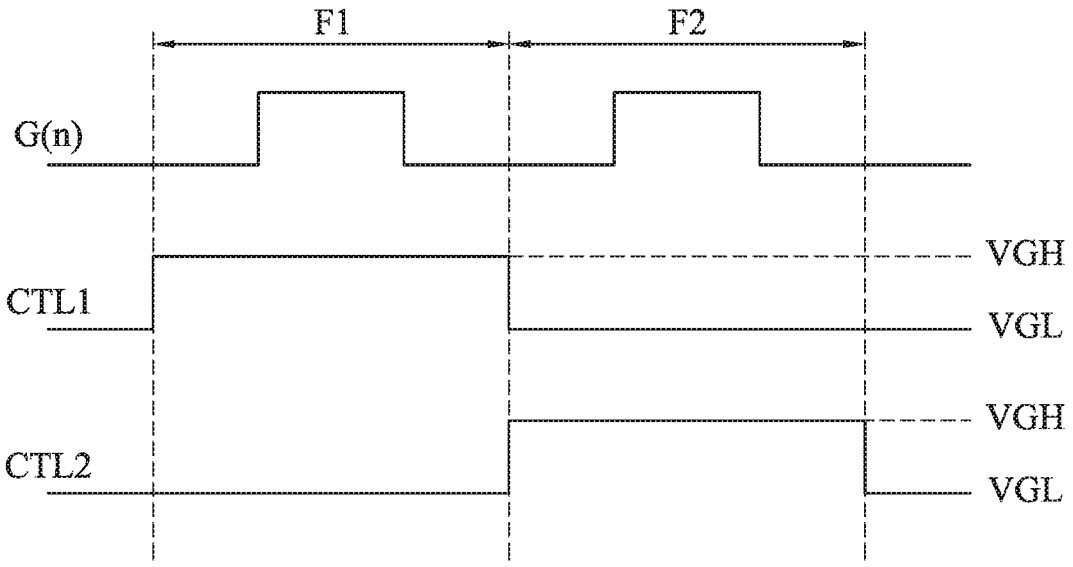
FIG. 3B is a timing diagram illustrating the multiplexer according to a first embodiment of this disclosure.

In another embodiment, reference is made to FIG. 3B, which is a timing diagram illustrating the multiplexer according to a first embodiment of this disclosure. As shown in FIG. 3B, during the frame F1, the control signal CTL1 maintained at the high level VGH, and then, during the frame F2, the control signal CTL1 switches to the low voltage level VGL. During the frame F1, the control signal CTL2 maintained at the low level VGL, and then, during the frame F2, the control signal CTL2 switches to the high voltage level VGH. In this case, when the gate driving signal G(n) switches to the enable voltage level, the gate driving signal G(n) is configured to enable gate line GL(n). Because the control signal CTL1 maintained at the high voltage level VGH in the frame F1, the switches T1, T2, T5 and T6 are conducted. Therefore, the data voltage is written to the pixel circuit coupled to the gate line GL(n) and the data lines DL(1), DL(2), DL(5) and DL(6). For the similar reason, the control signal CTL2 maintained at the high voltage level VGH in the frame F2. Thus, when the switches T3, T4, T7 and T8 are conducted by the gate driving signal G(n), the data voltage is written to the pixel circuit coupled to the gate line GL(n) and the data lines DL(3), DL(4), DL(7) and DL(8).

Figure 4:
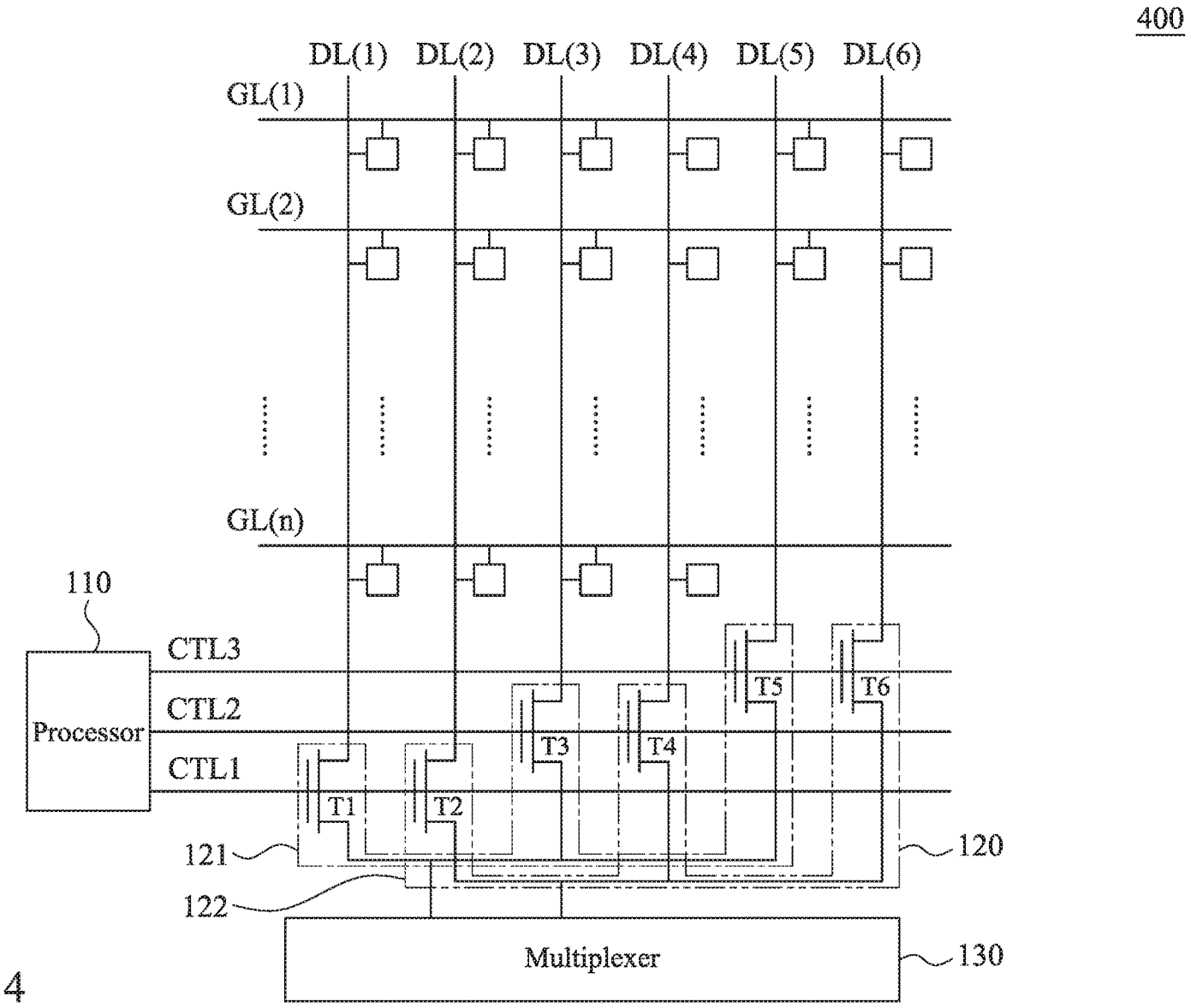
FIG. 4 is a circuit diagram of a display device 400 according to one embodiment of the present disclosure.

In another embodiment, reference is made to FIG. 4, which is a circuit diagram of a display device 400 according to one embodiment of the present disclosure. As shown in FIG. 4, the display device 400 includes a processor 110, multiplexers 120, a source driver 130, data lines DL(1)~DL(6) and gate lines GL(1)~GL(n). The multiplexers 120 are electrically coupled to the data lines DL and the source driver 130. With respect to the two multiplexers 121 and 122 and the associated switches T1~T6 as the embodiment shown in FIG. 4. The multiplexers 121 is electrically coupled to the odd-numbered data lines DL(1), DL(3) and DL(5), and the multiplexers 122 is electrically coupled to the even-numbered data lines DL(2), DL(4) and DL(6). The processor 110 is configured for providing the control signal CTL1, CTL2 and CTL3 to control the operation of the multiplexers 121 and 122.

Afterwards, the multiplexer 121 includes switches T1, T3 and T5. The first end of the switch T1 is electrically connected to the data line DL(1); the second end of the switch T1 is electrically connected to the source driver 130, and the control end of the switch T1 is configured to receive the control signal CTL1. The first end of the switch T3 is electrically connected to the data line DL(3); the second end of the switch T3 is electrically connected to the source driver 130, and the control end of the switch T3 is configured to receive the control signal CTL2. The first end of the switch T5 is electrically connected to the data line DL(5); the second end of the switch T5 is electrically connected to the source driver 130, and the control end of the switch T5 is configured to receive the control signal CTL3. The multiplexer 122 includes switches T2, T4 and T6. The first end of the switch T2 is electrically connected to the data line DL(2); the second end of the switch T2 is electrically connected to the source driver 130, and the control end of the switch T2 is configured to receive the control signal CTL1. The first end of the switch T4 is electrically connected to the data line DL(4); the second end of the switch T4 is electrically connected to the source driver 130, and the control end of the switch T4 is configured to receive the control signal CTL2. The first end of the switch T6 is electrically connected to the data line DL(6); the second end of the switch T6 is electrically connected to the source driver 130, and the control end of the switch T6 is configured to receive the control signal CTL3.

Figure 5:
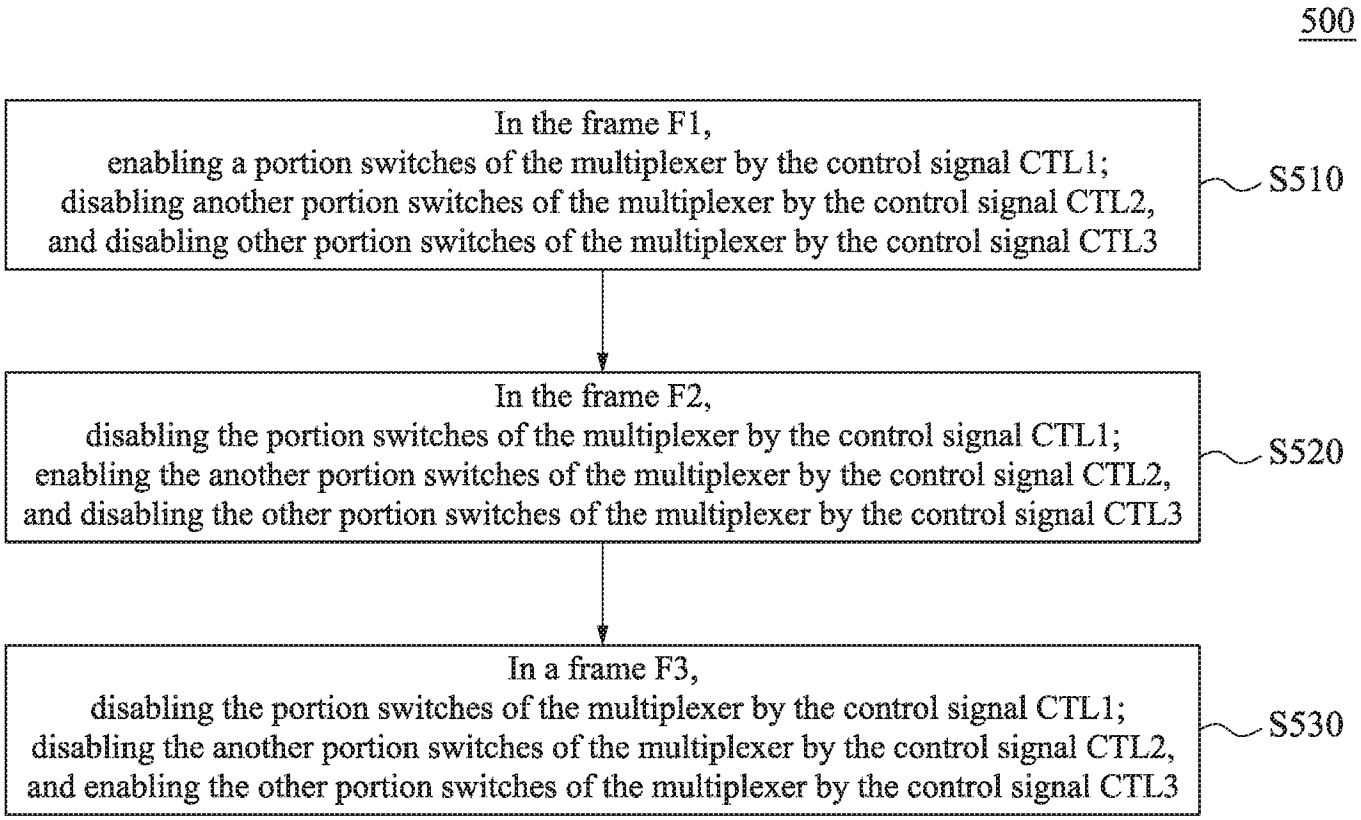
FIG. 5 is a flow diagram illustrating a method 500 for driving the multiplexer according to an embodiment of this disclosure.

Reference is made to FIG. 4 and FIG. 5. FIG. 5 is a flow diagram illustrating a method 500 for driving the multiplexer according to an embodiment of this disclosure. In the embodiment, the method 500 can be applied to the display device 400 of FIG. 4. The processor 110 is configured to conduct different multiplexers 120 to enable different data lines according to the steps described in the following method 500.

As shown in FIG. 5, the method 500 firstly executes step S510, in the frame F1, enabling a portion switches of the multiplexer by the control signal CTL1; disabling another portion switches of the multiplexer by the control signal CTL2, and disabling other portion switches of the multiplexer by the control signal CTL3. In this embodiment, the type of the multiplexer is the 1-to-3 multiplexer. In this case, the odd-numbered multiplexer is electrically connected to the corresponding odd-numbered data line; the even-numbered multiplexer is electrically connected to the corresponding even-numbered data line.

Figure 6A:
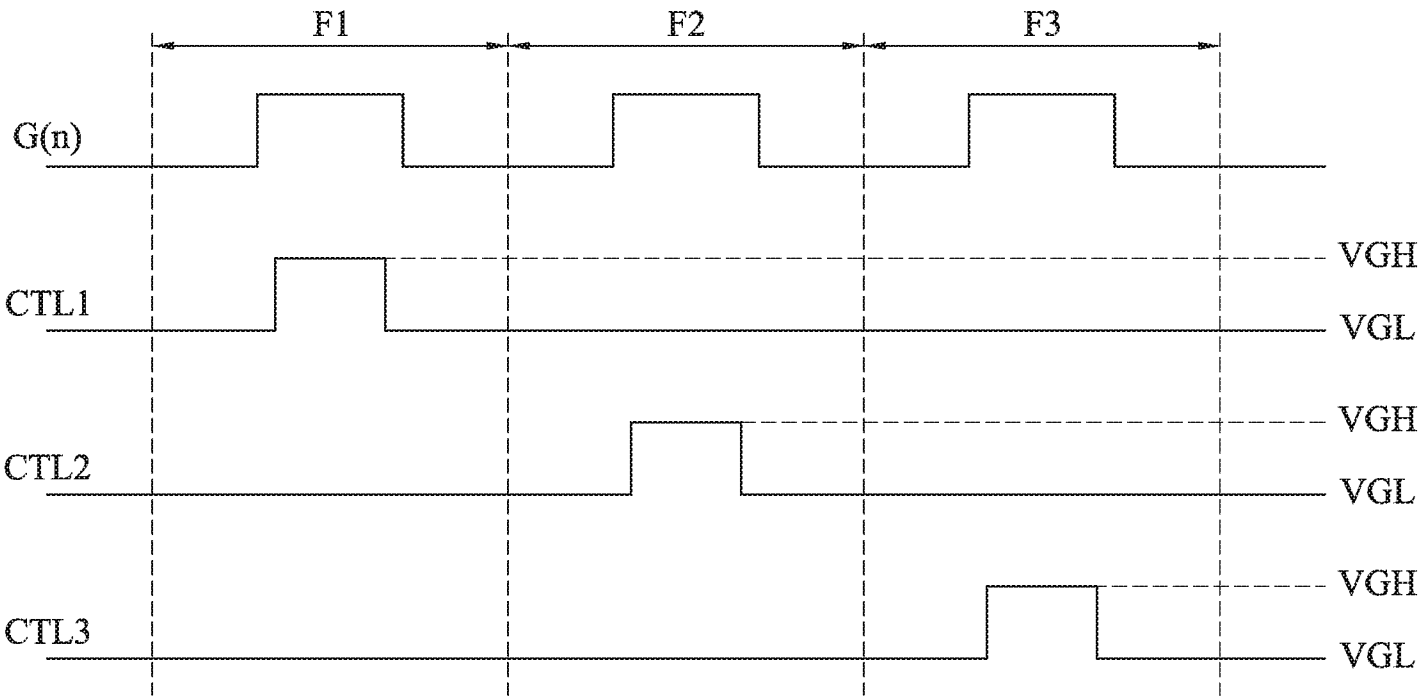
FIG. 6A is a timing diagram illustrating the multiplexer according to a first embodiment of this disclosure.

Reference is made to FIG. 4 to FIG. 6A. FIG. 6A is a timing diagram illustrating the multiplexer according to a first embodiment of this disclosure. As shown in FIG. 6A, in the frame F1, the control signal CTL1 switches to a high voltage level VGH, and is configured to enable the switches T1 and T2. At the same time, the control signals CTL2 and CTL3 are at a low voltage level VGL, and is configured to disable the switches T3, T4, T5 and T6. When the gate driving signal G(n) switches to the enable voltage level, the gate driving signal G(n) is configured to enable gate line GL(n), and the control signal CTL1 is configured to enable the switches T1 and T2. When the switches T1 and T2 are conducted, the data voltage is written to the pixel circuit coupled to the gate line GL(n) and the data lines DL(1) and DL(2).

In this embodiment, the odd-numbered data line has the opposite voltage polarity to the even-numbered data line, and the multiplexers only conduct the portion switches in this operation. Thus, it is assumed that the update rate of the display device is 180 Hz determined by the gate driver (do not shown in figure), but actually the update rate of the display device will be down to 60 Hz.

Afterwards, the method 500 executes step S520, in a frame F2, disabling the portion switches of the multiplexer by the control signal CTL1; enabling the another portion switches of the multiplexer by the control signal CTL2, and disabling the other portion switches of the multiplexer by the control signal CTL3. As shown in FIG. 6A, in the frame F2, the control signals CTL1 and CTL3 are at the low voltage level VGL, and is configured to disable the switches T1, T2, T5 and T6. At the same time, the control signal CTL2 switches to the high voltage level VGH, and is configured to enable the switches T3 and T4. Based on aforesaid embodiments, when the gate driving signal G(n) switches to the enable voltage level, the gate driving signal G(n) is configured to enable gate line GL(n), and the control signal CTL2 is configured to enable the switches T3 and T4. When the switches T3 and T4 are conducted, the data voltage is written to the pixel circuit coupled to the gate line GL(n) and the data lines DL(3) and DL(4).

Afterwards, the method 500 executes step S530, in a frame F3, disabling the portion switches of the multiplexer by the control signal CTL1; disabling the another portion switches of the multiplexer by the control signal CTL2, and enabling the other portion switches of the multiplexer by the control signal CTL3. As shown in FIG. 6A, in the frame F3, the control signals CTL1 and CTL2 are at the low voltage level VGL, and is configured to disable the switches T1, T2, T3 and T4. At the same time, the control signal CTL3 switches to the high voltage level VGH, and is configured to enable the switches T5 and T6. Based on aforesaid embodiments, when the gate driving signal G(n) switches to the enable voltage level, the gate driving signal G(n) is configured to enable gate line GL(n), and the control signal CTL3 is configured to enable the switches T5 and T6. When the switches T5 and T6 are conducted, the data voltage is written to the pixel circuit coupled to the gate line GL(n) and the data lines DL(5) and DL(6).

Figure 6B:
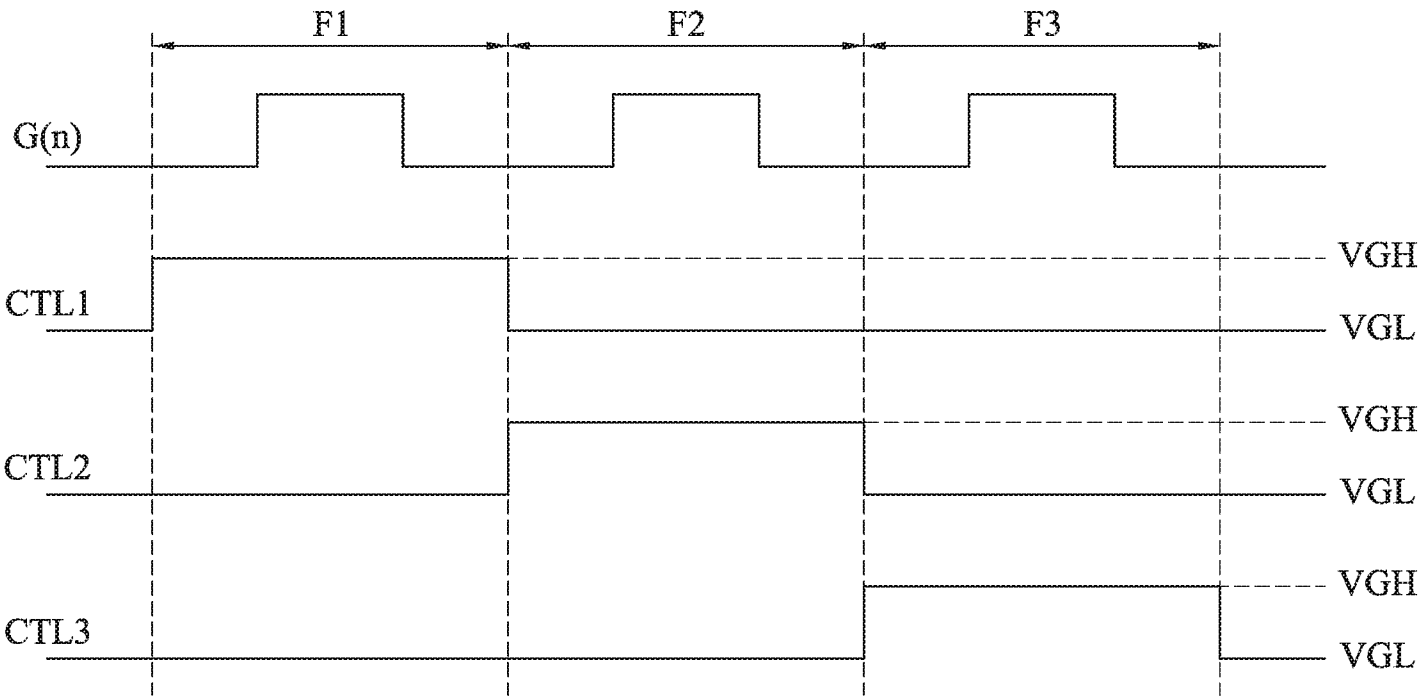
FIG. 6B is a timing diagram illustrating the multiplexer according to a first embodiment of this disclosure.

In another embodiment, reference is made to FIG. 6B, which is a timing diagram illustrating the multiplexer according to a first embodiment of this disclosure. As shown in FIG. 6B, during the frame F1, the control signal CTL1 maintained at the high level VGH, and then, during the frames F2 and F3, the control signal CTL1 switches to the low voltage level VGL. During the frames F1 and F3, the control signal CTL2 maintained at the low level VGL, and then, during the frame F2, the control signal CTL2 switches to the high voltage level VGH. During the frames F1 and F2, the control signal CTL3 maintained at the low level VGL, and then, during the frame F3, the control signal CTL3 switches to the high voltage level VGH. In this case, when the gate driving signal G(n) switches to the enable voltage level, the gate driving signal G(n) is configured to enable gate line GL(n). Because the control signal CTL1 maintained at the high voltage level VGH in the frame F1, the switches T1 and T2 are conducted. Therefore, the data voltage is written to the pixel circuit coupled to the gate line GL(n) and the data lines DL(1) and DL(2). For the similar reason, the control signal CTL2 maintained at the high voltage level VGH in the frame F2. Thus, when the switches T3 and T4 are conducted by the gate driving signal G(n), the data voltage is written to the pixel circuit coupled to the gate line GL(n) and the data lines DL(3) and DL(4). For the similar reason, the control signal CTL3 maintained at the high voltage level VGH in the frame F3. Thus, when the switches T5 and T6 are conducted by the gate driving signal G(n), the data voltage is written to the pixel circuit coupled to the gate line GL(n) and the data lines DL(5) and DL(6).

Based on aforesaid embodiments, the method for driving the multiplexer and display device thereof are capable of utilizing enabling different multiplexers during different frames to adjust the enabling frequency. This method allows the multiplexers to have a charging time equal to the enabling time period of the gate driving signal in each frame. This method not only avoids the problem of mischarge between the multiplexers, but also increases the charging time of the pixel circuit. Therefore, it can avoid the problem of insufficient charging time of the pixel circuit at high update rate.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to."

The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention indicated by the following claims.

What is claimed is:

1. A method for driving a multiplexer, applied to a display device, comprising:

in a first frame, enabling a portion switch of a first multiplexer and a portion switch of a second multiplexer by a first control signal, and disabling another portion switch of the first multiplexer and another portion switch of the second multiplexer by a second control signal; and in a second frame, disabling the portion switch of the first multiplexer and the portion switch of the second multiplexer by the first control signal, and enabling the another portion switch of the first multiplexer and the another portion switch of the second multiplexer by the second control signal.

2. The method for driving the multiplexer of claim 1, wherein the first multiplexer is configured to enable an odd-numbered data line, and the second multiplexer is configured to enable an even-numbered data line.

3. The method for driving the multiplexer of claim 1, further comprising:

in a third frame, disabling the portion switch of the first multiplexer and the portion switch of the second multiplexer by the first control signal; disabling the another portion switch of the first multiplexer and the another portion switch of the second multiplexer by the second control signal, and enabling an other portion switch of the first multiplexer and an other portion switch of the second multiplexer by a third control signal.

4. The method for driving the multiplexer of claim 1, wherein the first multiplexer comprises a first switch and a second switch, and the second multiplexer comprises a third switch and a fourth switch.

5. The method for driving the multiplexer of claim 4, wherein in the first frame, enabling the first switch and the third switch by the first control signal, and disabling the second switch and the fourth switch by the second control signal; and in the second frame, disabling the first switch and the third switch by the first control signal, and enabling the second switch and the fourth switch by the second control signal.

6. The method for driving the multiplexer of claim 3, wherein the first multiplexer comprises a first switch, a second switch and a third switch, and the second multiplexer comprises a fourth switch, a fifth switch and a sixth switch.

7. The method for driving the multiplexer of claim 6, wherein in the first frame, enabling the first switch and the fourth switch by the first control signal, disabling the second switch and the fifth switch by the second control signal, and disabling the third switch and the sixth switch by the third control signal;

in the second frame, disabling the first switch and the fourth switch by the first control signal, enabling the second switch and the fifth switch by the second control signal, and disabling the third switch and the sixth switch by the third control signal;

in the third frame, disabling the first switch and the fourth switch by the first control signal, disabling the second switch and the fifth switch by the second control signal, and enabling the third switch and the sixth switch by the third control signal.

8. A display device, comprising:

a plurality of gate lines;

a plurality of data lines;

a plurality of multiplexers, electrically connected to the plurality of data lines, wherein the plurality of multiplexers comprise a first multiplexer and a second multiplexer; and a processor, electrically connected to the plurality of multiplexers, in a first frame, the processor is configured to enable a portion switch of the first multiplexer and a portion switch of the second multiplexer by a first control signal, and disable another portion switch of the first multiplexer and another portion switch of the second multiplexer by a second control signal; and in a second frame, the processor is configured to disable the portion switch of the first multiplexer and the portion switch of the second multiplexer by the first control signal, and enable the another portion switch of the first multiplexer and the another portion switch of the second multiplexer by the second control signal.

9. The display device of claim 8, wherein the first multiplexer is configured to enable an odd-numbered data line, and the second multiplexer is configured to enable an even-numbered data line.

10. The display device of claim 8, wherein in a third frame, the processor is further configured to disable the portion switch of the first multiplexer and the portion switch of the second multiplexer by the first control signal; disable the another portion switch of the first multiplexer and the another portion switch of the second multiplexer by the second control signal, and enable an other portion switch of the first multiplexer and an other portion switch of the second multiplexer by a third control signal.

11. The display device of claim 8, wherein the first multiplexer comprises a first switch and a second switch, and the second multiplexer comprises a third switch and a fourth switch.

12. The display device of claim 11, wherein a control end of the first switch and a control end of the third switch are configured to receive the first control signal; a control end of the second switch and a control end of the fourth switch are configured to receive the second control signal.

13. The display device of claim 10, wherein the first multiplexer comprises a first switch, a second switch and a third switch, and the second multiplexer comprises a fourth switch, a fifth switch and a sixth switch.

14. The display device of claim 13, wherein a control end of the first switch and a control end of the fourth switch are configured to receive the first control signal; a control end of the second switch and a control end of the fifth switch are configured to receive the second control signal; a control end of the third switch and a control end of the sixth switch are configured to receive the third control signal.

15. The display device of claim 13, wherein in the first frame and the second frame, the processor is configured to disable the third switch and the sixth switch by the third control signal.

* * * * *